US011198587B2

(12) United States Patent
Mustonen et al.

(10) Patent No.: US 11,198,587 B2
(45) Date of Patent: Dec. 14, 2021

(54) DEPLOYMENT OF A CONTROLLER IN AN ELEVATOR

(71) Applicant: KONE Corporation, Helsinki (FI)

(72) Inventors: Matti Mustonen, Hyvinkää (FI); Jouko Kinnari, Helsinki (FI); Jani Hautakorpi, Helsinki (FI)

(73) Assignee: KONE CORPORATION, Helsinki (FI)

( * ) Notice: Subject to any disclaimer, the term of this patent is extended or adjusted under 35 U.S.C. 154(b) by 851 days.

(21) Appl. No.: 15/969,322

(22) Filed: May 2, 2018

(65) Prior Publication Data

US 2018/0319625 A1 Nov. 8, 2018

(30) Foreign Application Priority Data

May 3, 2017 (EP) ..... 17169238

(51) Int. Cl.
*B66B 5/00* (2006.01)
*B66B 1/34* (2006.01)
(Continued)

(52) U.S. Cl.
CPC ..... *B66B 5/0087* (2013.01); *B66B 1/2408* (2013.01); *B66B 1/28* (2013.01);
(Continued)

(58) Field of Classification Search
CPC ..... B66B 5/0087; B66B 19/007; B66B 1/2408; B66B 1/28; B66B 1/3438; B66B 1/3407; B66B 1/02
See application file for complete search history.

(56) References Cited

U.S. PATENT DOCUMENTS

2015/0274488 A1* 10/2015 Ramakrishnan ..... B66B 1/18 187/387
2017/0144858 A1* 5/2017 Gandhi ..... H04L 67/34
(Continued)

FOREIGN PATENT DOCUMENTS

EP 0 523 601 A1 1/1993
WO WO 2014/108594 A2 7/2014
WO WO 2014/200464 A1 12/2014

OTHER PUBLICATIONS

European Search Report, issued in Application No. 17 16 9238, dated Oct. 9, 2017.

*Primary Examiner* — Jeffrey Donels
(74) *Attorney, Agent, or Firm* — Birch, Stewart, Kolasch & Birch, LLP

(57) ABSTRACT

A method for deploying a controller to an elevator system includes generating a request to at least one other controller for obtaining at least one parameter relating to a deployment of the controller to the elevator system, receiving a response, and in response to detection that the at least one parameter in the response comprises a set of operational parameters, initiating a configuration procedure, and in response to detection that the at least one parameter in the response does not comprise the set of operational parameters, deriving an identifier of the elevator system included as the at least one parameter in the response and generating a request including the identifier of the elevator system for obtaining the set of operational parameters. An elevator system is configured to perform the method.

13 Claims, 2 Drawing Sheets

(51) Int. Cl.
*B66B 19/00* (2006.01)
*B66B 1/24* (2006.01)
*B66B 1/28* (2006.01)

(52) U.S. Cl.
CPC ..... *B66B 1/3407* (2013.01); *B66B 1/3438* (2013.01); *B66B 19/007* (2013.01)

(56) References Cited

U.S. PATENT DOCUMENTS

2018/0162685 A1* 6/2018 Mustonen ..... B66B 1/3407
2019/0140896 A1* 5/2019 Gesch ..... H04L 41/0806

* cited by examiner

DEPLOYMENT OF A CONTROLLER IN AN ELEVATOR

TECHNICAL FIELD

The invention concerns in general the technical field of elevators. More particularly, the invention concerns maintenance of an elevator system.

BACKGROUND

An elevator system comprises a plurality of controller circuits configured to control specific tasks dedicated to the controller in question. As non-limiting examples, the elevator system may comprise a safety controller, a door controller, drive controller (i.e. typically a frequency controller) and an elevator controller, wherein the elevator controller may operate as a master device for the other controllers and any other devices belonging to the elevator system. For example, the elevator controller may obtain either directly or indirectly through another controller sensor data by means of which the elevator controller may generate information representing operational status of the elevator system in question. Additionally, the elevator controller may receive requests, such as landing calls from passengers e.g. through a user interface in a floor, on the basis of which the elevator controller may generate control signals e.g. to drive controller, for example.

When a controller installed in the elevator system is replaced with a new controller it requires a visit of a technician on the site. In practice the technician removes the old controller, installs the new controller by connecting cables as well fixing the controller in place, and configures the controller manually to have all necessary data, such as operational parameters, in the controller for performing the operation specific to the controller in question. As may be seen from the described procedure the replacement of a controller generates a lot of work and especially the configuration of the controller may turn out to be time-consuming task to do. This, in turn, prevents the use of the elevator and generates dissatisfaction in passengers.

There are some proposals to automate the configuration, i.e. the deployment, of the controller at least in part. This kind of approach is based on a solution in which the technician takes a back-up of data from the old controller and uses the back-up data in the new controller. However, this still requires some manual configuration work from the technician e.g. due to changes in the components in the controller, or any similar reason, and is impossible to perform if the old controller is got totally broken and it is not possible to access any more.

Thus, there is still need to introduce novel approaches for mitigating the above described challenges at least in part when deploying a controller circuit in elevators.

SUMMARY

The following presents a simplified summary in order to provide basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

An objective of the invention is to present a method and an elevator system for deploying a new device to an elevator system. Another objective of the invention is that the method and the elevator system enable a deployment of a controller to the elevator system.

The objectives of the invention are reached by a method and an elevator system as defined by the respective independent claims.

According to a first aspect, a method for deploying a controller to an elevator system is provided, the method comprises: generating a request to at least one other controller belonging to the elevator system for obtaining at least one parameter relating to a deployment of the controller to the elevator system; receiving a response comprising the at least one parameter from the at least one other controller; and in response to detection that the at least one parameter in the response comprises a set of operational parameters initiating a configuration procedure for deploying the controller based on the set of operational parameters received in the response, whereas in response to detection that the at least one parameter in the response does not comprise the set of operational parameters for deploying the controller deriving an identifier of the elevator system included as the at least one parameter in the response and generating a request comprising the identifier of the elevator system to an entity external to the elevator system for obtaining the set of operational parameters for initiating the configuration procedure.

The detection that the at least one parameter in the response comprises the set of operational parameters may be performed by detecting that a pre-defined data field in the response comprises data.

The identifier of the elevator system may be derived from a pre-defined data field in the response deviating from the data field dedicated to the set of operational parameters.

According to a first aspect, an elevator system is provided, the elevator system comprising: a first controller and at least one second controller, wherein the first controller is configured to: generate a request to at least one second controller for obtaining at least one parameter relating to a deployment of the controller to the elevator system; receive a response comprising the at least one parameter from the at least one second controller; and initiate, in response to detection that the at least one parameter in the response comprises a set of operational parameters, a configuration procedure based on the set of operational parameters received in the response, whereas derive, in response to detection that the at least one parameter in the response does not comprise the set of operational parameters, an identifier of the elevator system included as the at least one parameter in the response, and generate a request comprising the identifier of the elevator system to an entity external to the elevator system for obtaining the set of operational parameters for initiating the configuration procedure.

The first controller may be configured to perform the detection that the at least one parameter in the response comprises the set of operational parameters by detecting that a pre-defined data field in the response comprises data.

Moreover, the first controller may be configured to derive the identifier of the elevator system from a pre-defined data field in the response deviating from the data field dedicated to the set of operational parameters.

At least one of the following: the first controller, the at least one second controller may be one of the following: an elevator controller, a door controller, a drive controller, a safety controller.

The expression "a number of" refers herein to any positive integer starting from one, e.g. to one, two, or three.

The expression "a plurality of" refers herein to any positive integer starting from two, e.g. to two, three, or four.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

The embodiments of the invention are illustrated by way of example, and not by way of limitation, in the figures of the accompanying drawings.

DESCRIPTION OF THE EXEMPLIFYING EMBODIMENTS

The specific examples provided in the description given below should not be construed as limiting the scope and/or the applicability of the appended claims. Lists and groups of examples provided in the description given below are not exhaustive unless otherwise explicitly stated.

Figure 1:
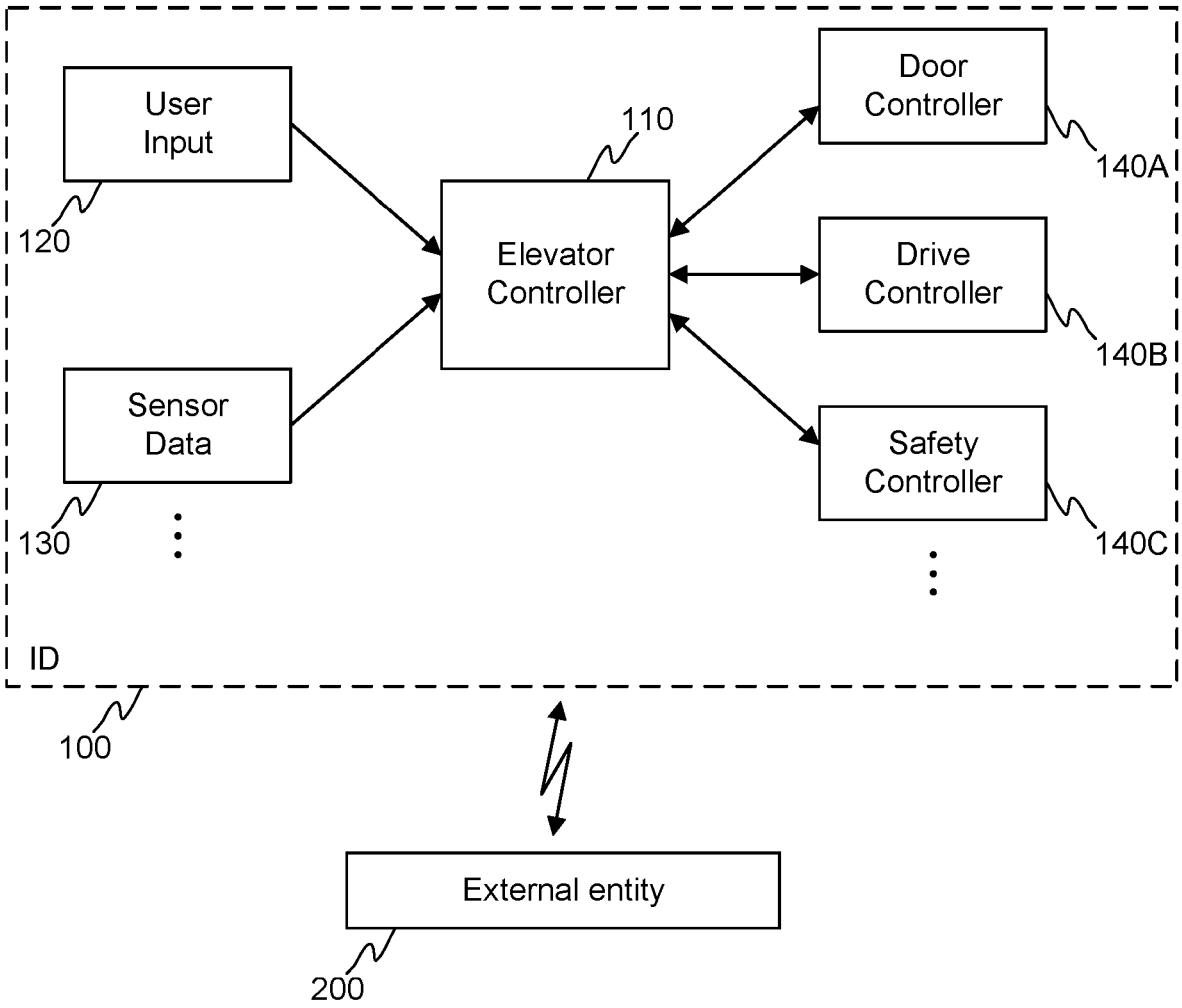
FIG. 1 illustrates schematically a non-limiting example of an elevator system.

FIG. 1 schematically illustrates an example of an elevator system 100 comprising a plurality of controllers that are performing predetermined tasks in order to enable an operation of the elevator system 100 on their own behalf. In the example of FIG. 1 an elevator controller 110 is an entity configured to control at least in part an overall operability of the elevator system 100. For example, the elevator controller 110 may obtain information from different sources, such as receiving user input 120 as landing calls and obtaining sensor data 130 from one or more sensors configured to gather information of the elevator system. The elevator controller 110 may also obtain information from other sources than shown in FIG. 1. Furthermore, the elevator controller 110 may be at least communicatively coupled to a plurality of further entities. At least some of the further entities may be a number of controllers of at least some sub-entities belonging to the elevator system. In the example of FIG. 1 the number of controllers may comprise a door controller 140A, a drive controller 140B and a safety controller 140C, for example. Still further, the elevator system 100 may be communicatively coupled to an external entity 200, such as a data center, which may e.g. maintain information relevant to the elevator system 100 and its components. For example, the external entity 200, such as the data center, may comprise information by means of which it may be possible to configure the elevator system 100 and at least some of its components. The elevator system 100 may be identified in the external entity 200 e.g. with an identifier (shown as ID in FIG. 1) included in a communication from the elevator system 100 to the external entity 200. The identifier may e.g. represent an identifier of an elevator system.

The elevator system 100 schematically illustrated in FIG. 1 does not necessarily disclose all entities belonging to the elevator system. For example, FIG. 1 does not disclose for clarity reasons a communication bus in the elevator system or a communication interface through which the communication with the external entity 200 may be performed.

In order to describe at least some aspects of the present invention it is now assumed that an elevator controller is replaced with a new elevator controller 110, and the new elevator controller 110 is to be deployed. However, the present invention is not only limited to a replacement of the elevator controller 110 and the deployment of it, but the fundamental idea of the present invention may also be applied in a context of a replacement of any other controller than the elevator controller 110. Now, a technician arrives in the site and removes the old controller, i.e. the elevator controller 110 from the elevator system 100 and installs a new one in place. The installation may comprise a mechanical fixing, but also an attachment of cables in order to provide power to the controller, and enabling a communicative coupling of it to the elevator system 100. The communicative coupling to the elevator system 100 may e.g. be arranged through a communication bus applicable in the elevator solutions, such as LON (Local Operating Network) bus or CAN (Controller Area Network) bus. The controller in question is advantageously configured to perform a communication protocol implemented in the communication channel into which it is coupled to. Furthermore, the elevator system may comprise a communication device, such as a modem, having at least one communication interface by means of which a communication channel may be established from the elevator system 100 to the external entity to the elevator system 100, such as a data center. The communication channel may be implemented either in a wired manner or wirelessly. The communication device may be coupled to the communication bus in any known manner in order to enable communication of the entities of the elevator system 100 with the external entity 200.

Figure 2:
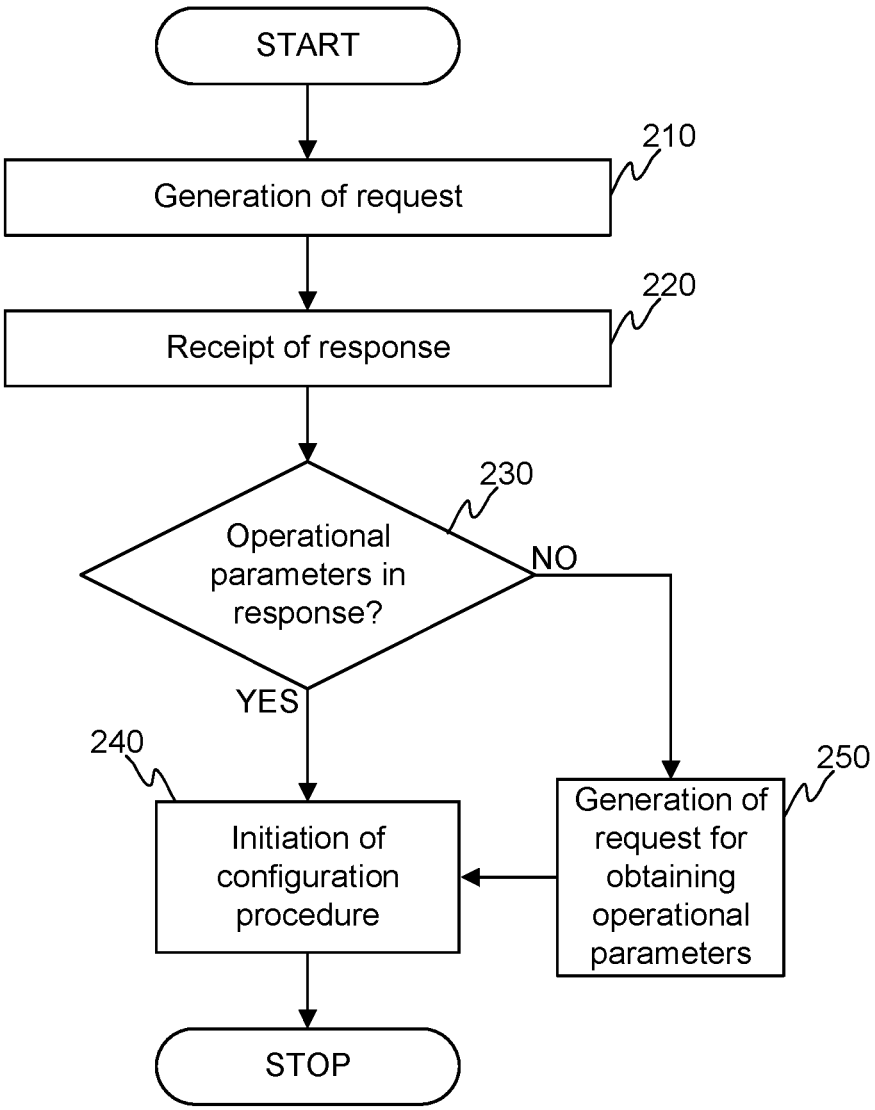
FIG. 2 illustrates schematically an example of a method according to an embodiment of the invention.

Now, at least some aspects of a deployment of a controller, such as an elevator controller 110, in the elevator system 100 is described by referring to FIG. 2 schematically illustrating at least some aspects of the method according to an embodiment.

Regarding step 210:

The new elevator controller 110 may be configured so that when the power is provided to it and it is communicatively coupled in the elevator system 100 the elevator controller 110 is configured to generate a request and to deliver it to the communication channel in question. The request may be determined so that it indicates that the controller requests one or more parameters by means of which the elevator controller 110 may be deployed in the elevator system 100 and it may start operating as a part of the elevator system 100. The indication may e.g. be achieved by defining a predetermined data value, or data string, in the request, which is interpreted by the receiver accordingly. In other words, the receiver of the request may be configured to determine the data value, or the data string, from the request and to operate accordingly.

Moreover, the request may comprise a further piece of information which defines the controller type which is requesting the at least one parameter. The type of the controller may refer, but is not limited to, to the controllers as shown in FIG. 1, for example. By providing the controller type in the request the receiver of the request may obtain, in one embodiment of the invention, a correct parameter or parameters corresponding to the controller type to be returned to the controller requesting the information.

Still further, the request may comprise an identifier of the new controller and it is also possible to arrange that the request comprises a destination address of at least one other controller from which the at least one parameter is requested.

Generally speaking, the request shall be considered to comprise an indication that the new controller, such as the elevator controller 110, needs at least one parameter relating to deployment of the controller in question to the elevator system 100. Depending on an implementation the request may comprise further data values, or one or more pieces of information, as described above.

Regarding step 220:

In response to the request 210 the elevator controller 110 may receive a response from at least one other controller, which has received the request and generates the response. The response may be delivered through the communication channel, such as the communication bus, arranged between the controllers.

Regarding step 230:

The controller, i.e. the elevator controller 110, may be configured to detect data included in the response 220 and to determine the content of the data in the response.

The determination of the content of the data may generate detection that the response comprises a set of operational parameters, which may be used in a deployment of the controller in the elevator system 100. Alternatively, the determination may generate detection that the response does not comprise the set of operational parameters, but at least one other parameter, such as an identifier of the elevator system 100 into which the elevator controller 110 is coupled to.

The differentiation between the mentioned detections may e.g. be based on determination if certain fields in the response comprise data or not. For example, the response message may be formulated so that there are separate fields for the identifier of the elevator system 100 and for the set of operational parameters. Into these fields the controller generating the response inputs data which it possesses. In an embodiment the input of the fields is alternate, i.e. data is input only to one of the fields. In some other embodiment the identifier is always input to the dedicated, i.e. pre-defined, field, but the data field for the at least one set of operational parameters is only input if the controller generating the response possesses the requested data. As a result, the controller under deployment may be configured to determine the content of the mentioned fields and to operate accordingly as is described herein. Worthwhile is to mention that in some embodiment the detection may be based on a combined information in a plurality of fields or even to data transmitted in a plurality of response messages.

Regarding step 240:

In response to the detection in step 230 that the response comprises the set of operational parameters for the controller, i.e. the elevator controller 110 in the present example, may be configured to initiate a predetermined configuration procedure in which the set of operational parameters is taken into use, or applied, in the controller in question and, as a result, the controller may be deployed in the elevator system 100. In other words, the new controller 110 gets configured so that it operates as desired in the elevator system 100 in question.

Regarding step 250:

In response to the detection in step 230 that the response does not comprise a set of operational parameters needed for deploying the controller, i.e. the elevator controller 110 in the present example, the controller may be configured to initiate a generation of a request to an external entity 200 to the elevator system 100 for obtaining the set of operational parameters for the controller in question. The generation of the request 250 comprises at least an establishment of the request message and transmittance of it to the recipient, as discussed below. For doing this the controller may e.g. be configured to, in one embodiment, determine an identifier representing the elevator system 100 into which it is installed to. The determination of the elevator system 100 identifier may be arranged so that the identifier is derived from the response 220 received from the at least one other controller into which the identifier may be included as a parameter e.g. in one predefined field in the response. This kind of implementation is based on an arrangement that the at least one other controller is configured to store the elevator system 100 identifier and to include it to the response message possibly with other data, such as an identifier of the controller in question, as described above. Now, in response to the determination, or detection, of the elevator system 100 identifier the new controller installed in the system may be configured to generate the request for obtaining the set of operational parameters by adding at least the determined elevator system 100 identifier to the request and transmit it to the external entity. The external entity 200 may e.g. be a data center at least maintaining information on the elevator system 100 in question. A functionality of the data center may be arranged with a single network node, such as a server, or it may be implemented as a distributed solution among a plurality of network nodes and/or devices. The data center may obtain, in response to the receipt of the request, by inquiring from data storage accessible to the data center a set of operational parameters. The inquiry may be performed to the data storage by identifying the elevator system 100 into which the controller is installed, but possibly in some embodiment also the identifier of the controller, in the inquiry and the data storage may be configured to return the set of operational parameters in a response to the controller. Accordingly, the controller, such as the elevator controller 110, may be deployed in the manner as discussed in the context of step 240 above.

Figure 3:
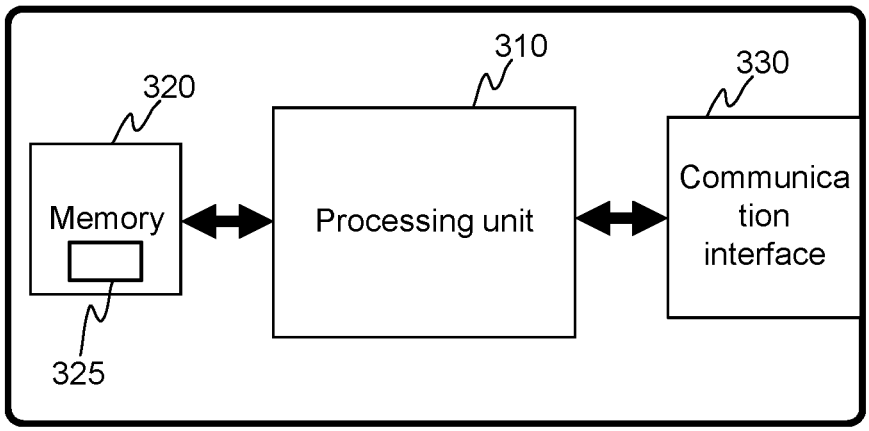
FIG. 3 illustrates schematically a non-limiting example of a controller to be deployed in the elevator system.

FIG. 3 illustrates schematically an example of a controller, such as an elevator controller 110 or any other controller shown e.g. in FIG. 1, to be deployed in the elevator system 100. The controller comprises a processing unit 310 including one or more processors, one or more memories 320 and one or more communication interfaces 330 which entities may be communicatively coupled to each other with e.g. a data bus. The communication interface 330 may comprise necessary hardware and functionality for coupling the controller into the communication bus in the elevator system. Naturally, the controller may also be coupled directly to another entity through the communication interface. The communication interface 330 may be at least partly controlled by the one or more processors 310 e.g. by executing portions of computer program code 325 stored in the one or more memories 320. Moreover, the computer program code 325 may define instructions that cause the controller to operate as described when at least one portion of the computer program code 325 is executed by the processing unit 310. Naturally, the controller schematically illustrated in FIG. 3 does not comprise all elements of the controller. For example, the power related elements needed for bringing an electrical device, such as the controller, into operation are not shown in FIG. 3. Moreover, an identifier of the controller may be stored in the memory 320 and it may enclosed to any communication from the controller in question.

For sake of clarity it is worthwhile to emphasize that the elevator system 100 may comprise a communication interface through which the entities belonging to the elevator system 100 may communicate with one or more external entities. The communication interface may comprise one or more communication devices, such as modems, by means of which the communication with the one or more external entities may be arranged. The entities, such as the controllers, in the elevator system 100 may be coupled to the communication interface e.g. through the communication bus in the elevator system 100.

As discussed one aim of the present invention is to obtain at least one set of operational parameters to the controller to be deployed in the system. Depending on the type of controller the operational parameters needed for the deployment may vary. In the following some non-limiting examples of the operational parameters which may be needed for deploying the controller in question are brought out on the basis of the controller type:

Elevator controller:
Nominal speed and rated load of an elevator
Roping ratio
number of floors
Door controller:
Weight of door leaves
Speed and acceleration values
Drive controller:
Torque limit
Encoder pulses per motor round
Motor armature voltage
Safety controller:
Installed safety components
Safety limits The above given parameters are non-limiting examples and may vary. It is also necessary to mention that the parameters of the controllers may affect either the operation of the controller in question or any device the controller in question controls or monitors.

The specific examples provided in the description given above should not be construed as limiting the applicability and/or the interpretation of the appended claims. Lists and groups of examples provided in the description given above are not exhaustive unless otherwise explicitly stated.

What is claimed is:

1. A method for deploying a controller to an elevator system, the method comprising the steps of:

generating a request to at least one other controller belonging to the elevator system for obtaining information relating to a deployment of the controller to the elevator system;

receiving a response comprising the information from the at least one other controller;

in response to detection that the information in the response comprises a set of operational parameters, initiating a configuration procedure for deploying the controller based on the set of operational parameters received in the response; and in response to detection that the information in the response does not comprise the set of operational parameters for deploying the controller, deriving an identifier of the elevator system included in the information in the response and generating a request comprising the identifier of the elevator system to an entity external to the elevator system for obtaining the set of operational parameters for initiating the configuration procedure.

2. The method of claim 1, wherein the detection that the information in the response comprises the set of operational parameters is performed by detecting that a first pre-defined data field in the response dedicated to the set of operational parameters comprises data, and wherein the detection that the information in the response does not comprise the set of operational parameters is performed by detecting that the first pre-defined data field in the response dedicated to the set of operational parameters does not comprise data.

3. The method of claim 2, wherein the identifier of the elevator system is derived from a second pre-defined data field in the response different from the first pre-defined data field dedicated to the set of operational parameters.

4. An elevator system, comprising:

a first controller and at least one second controller, wherein the first controller is configured to:

generate a request to at least one second controller for obtaining information relating to a deployment of the controller to the elevator system;

receive a response comprising the information from the at least one second controller;

initiate, in response to detection that the information in the response comprises a set of operational parameters, a configuration procedure based on the set of operational parameters received in the response; and derive, in response to detection that the information in the response does not comprise the set of operational parameters, an identifier of the elevator system included in the information in the response, and generate a request comprising the identifier of the elevator system to an entity external to the elevator system for obtaining the set of operational parameters for initiating the configuration procedure.

5. The elevator system of claim 4, wherein the first controller is configured to perform the detection that the information in the response comprises the set of operational parameters by detecting that a first pre-defined data field in the response dedicated to the set of operational parameters comprises data, and wherein the first controller is configured to perform the detection that the information in the response comprises the set of operational parameters by detecting that the first pre-defined data field in the response dedicated to the set of operational parameters does not comprise data.

6. The elevator system of claim 5, wherein the first controller is configured to derive the identifier of the elevator system from a second pre-defined data field in the response different from the first pre-defined data field dedicated to the set of operational parameters.

7. The elevator system of claim 4, wherein the first controller is one of the following: an elevator controller, a door controller, a drive controller, a safety controller.

8. The elevator system of claim 4, wherein the second controller is one of the following: an elevator controller, a door controller, a drive controller, a safety controller.

9. The elevator system of claim 5, wherein the first controller is one of the following: an elevator controller, a door controller, a drive controller, a safety controller.

10. The elevator system of claim 6, wherein the first controller is one of the following: an elevator controller, a door controller, a drive controller, a safety controller.

11. The elevator system of claim 5, wherein the second controller is one of the following: an elevator controller, a door controller, a drive controller, a safety controller.

12. The elevator system of claim 6, wherein the second controller is one of the following: an elevator controller, a door controller, a drive controller, a safety controller.

13. The elevator system of claim 7, wherein the second controller is one of the following: an elevator controller, a door controller, a drive controller, a safety controller.

* * * * *